428-408 SR
1/26/82 XR 4,312,913

United States Patent [19]
Rheaume

[11] 4,312,913
[45] Jan. 26, 1982

[54] HEAT CONDUCTIVE FABRIC

[75] Inventor: Walter A. Rheaume, Fullerton, Calif.

[73] Assignee: Textile Products Incorporated, Anaheim, Calif.

[21] Appl. No.: 149,003

[22] Filed: May 12, 1980

[51] Int. Cl.[3] ..... B32B 7/00; D03D 13/00; B32B 5/12

[52] U.S. Cl. ..... 428/257; 139/425 R; 139/408; 428/263; 428/265; 428/268; 428/337; 428/388; 428/408

[58] Field of Search ..... 428/245, 265, 268, 273, 428/257, 258, 259, 379, 388, 267; 139/408, 415, 425 R

[56] References Cited

U.S. PATENT DOCUMENTS

| | | | |
|---|---|---|---|
| 2,899,987 | 8/1959 | Finken et al. | 139/408 |
| 2,915,806 | 12/1959 | Grant | 428/388 |
| 2,930,105 | 3/1960 | Budd | 428/388 |
| 3,646,749 | 3/1972 | Clough et al. | 139/425 R |
| 4,107,368 | 8/1978 | Ratcliffe et al. | 139/425 R |
| 4,234,648 | 11/1980 | Patz et al. | 428/257 |

FOREIGN PATENT DOCUMENTS

| | | | |
|---|---|---|---|
| 187061 | 11/1955 | Fed. Rep. of Germany | 139/408 |
| 52-74074 | 1/1977 | Japan | 139/425 R |

*Primary Examiner*—James J. Bell
*Attorney, Agent, or Firm*—Willie Krawitz

[57] ABSTRACT

Weavable yarns whose fibers are metallic or have a heat conducting, metallized coating are woven together with a plurality of yarn layers using, say, an angle weave to produce an interlocked, multilayer fabric. The fabric provides heat conduction paths for the efficient transferring of heat from a substrate.

Typical coated or metallic fibers which may be employed in the yarn include glass, graphite, ceramic, polyester, nylon, rayon, cotton, wool, acrylonitrile, etc.; metallic fibers such as copper, aluminum and steel are also suitable. A preferred heat conductive coating comprises an aluminum, aluminum alloy or other suitable metal which can be applied to a glass fiber.

15 Claims, 3 Drawing Figures

HEAT CONDUCTIVE FABRIC

BACKGROUND OF THE INVENTION

This invention relates to a new and improved fabric, and more specifically to a heat conductive fabric having interlocked, multilayers of yarn whose fibers are metallic or are coated with a metallic, heat conductive material.

Single layer fabrics have been utilized in the past for heat dissipation purposes, such as in solar panels, in glass backing, etc. These fabrics are manufactured on conventional equipment from glass yarns whose fibers are coated with a metallized material such as aluminum, and so forth. While a single layer of fabric may be suitable in situations where only moderate amounts of heat are generated, multiple fabric layers are desired where a large amount of heat dissipation is necessary. Prior art multiple fabric layers of metallized yarns that are employed to conduct heat have either been fused together with a resin coating or with a resin impregnation; the intention was to increase fabric strength and improve heat conduction of the fabric. However, in both cases, heat conduction using separate, fused fabric layers have proven unsatisfactory because the heat tends to flow laterally to the periphery of the fabric rather than perpendicularly through the fabric itself.

There is required a multilayer, heat conductive fabric which produces an effective and uniform heat conduction through the fabric layers, and also if desired, laterally to the periphery of the fabric.

THE INVENTION

According to the invention, a heat conductive fabric is provided, comprising a plurality of fill layers of weavable yarns, each yarn comprising a plurality of fibers that are metallic or are coated with an effective amount of a metallic, heat conducting material. The fill layers provide heat conductance in the fill direction. An angle weave pattern is woven through the layers of fill yarns, and the angle weave extends from top to bottom of the several layers of fill yarns. The warp angle weave affords heat conduction both through the fabric and also along the fabric length.

If desired, fill stuffer and warp stuffer yarns can be woven into the fabric to provide a thicker material and for insulating effects. Where appropriate, the fabric of this invention may be coated or impregnated with a resin, such as a polyimide, epoxy, etc. to improve stiffness, but this not necessary for the successful functioning of the fabric.

DESCRIPTION OF THE PREFERRED EMBODIMENT

Figure 1:
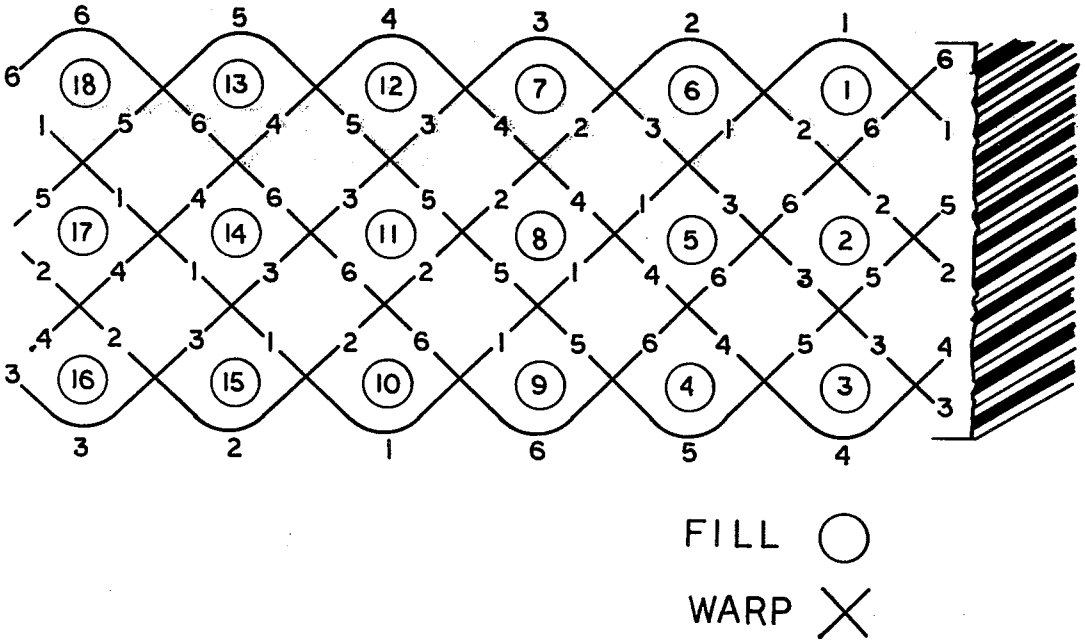
FIGS. 1–3 are schematic views in sectional side elevation showing various weave patterns of the interwoven, multilayer, heat conductive fabric of this invention.

FIG. 1 shows one form of the multilayer fabric, three individual fill layers being shown (circle designation) as 1, 6, 7, 12, 13 and 18; 2, 5, 8, 11, 14 and 17; and, 3, 4, 9, 10, 15 and 16. The multilayer fabric is produced on a C-3 Crompton & Knowles weaver by interweaving the fill layers together with a warp angle weave 1, 2, 3, 4, 5 and 6. The specific numbering associated with both the fill and warp yarns indicate the harness lift and weave sequence. If desired, the fabric may be coated or impregnated with a resin as shown.

In the fabric shown in FIG. 1, both the warp and fill yarns are typically made of glass fibers having a metallized coat such as aluminum, the fibers having a diameter in the order of about 18 microns. These types of metallized glass yarns are suitable for weaving into a heat conductive fabric and are sold by Lundy Technical Center, Pompano Beach, Florida under their trade name of "RoHMOglas" for heat conductive, metallized, glass fiber. The fibers furnished by Lundy Technical Center have a thin, smooth and flexible metallized coating bonded to the glass surface, and the metal comprises about 37 wt. % of the coated fiber.

As shown in FIG. 1, the arrangement of fill layers interwoven with the angle warp yarns produces a unitary, multilayer fabric having significantly improved heat conductive properties. By comparison, fabrics woven from the same metallic coated glass yarns but stacked in separate, non-woven, layers that are simply bonded together provide markedly inferior heat conductance effects. The multilayer fabric of this invention thus comprises an interweave that causes a major portion of the heat to flow through the fabric and along its length, primarily via the warp. A relatively minor amount of heat flow will occur across the width of the fabric via the fill layers. However, if the fill yarns are uncoated, they will act as insulators and reduce heat transfer across the fabric width.

Figure 2:
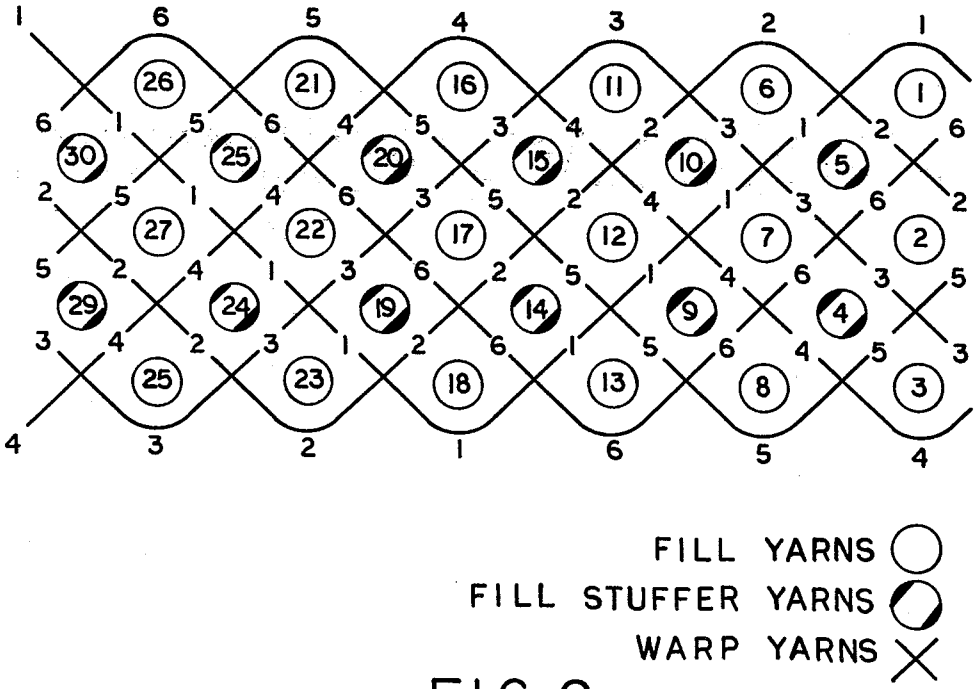

In FIG. 2, three individual fill layers are shown (circle designation) as 1, 6, 11, 16, 21 and 26; 2, 7, 12, 17, 22 and 27; and, 3, 8, 18, 23 and 28. These fill layers are interwoven together, as in FIG. 1, with an angle weave 1, 2, 3, 4, 5 and 6. Two layers of fill stuffer yarns (half shaded circles) are also woven into the fabric between each layer of fill yarns to produce a bulkier fabric. The fill stuffer yarns are made of fibers such as, e.g. graphite, polyester, nylon, glass, ceramic, rayon, cotton, wool, acrylonitrile, etc.; metallic fibers such as copper, aluminum and steel are also suitable. The yarn layers are shown as 5, 10, 15, 20, 25 and 30; and, 4, 9, 14, 19, 24 and 29. The major portion of heat flow will occur through the fill layers by conduction along the angle woven warp yarns. If insulation is desired in a particular direction, the fill stuffer yarns are employed without the metallized coating, and the stuffer yarns will then function as insulators.

Figure 3:
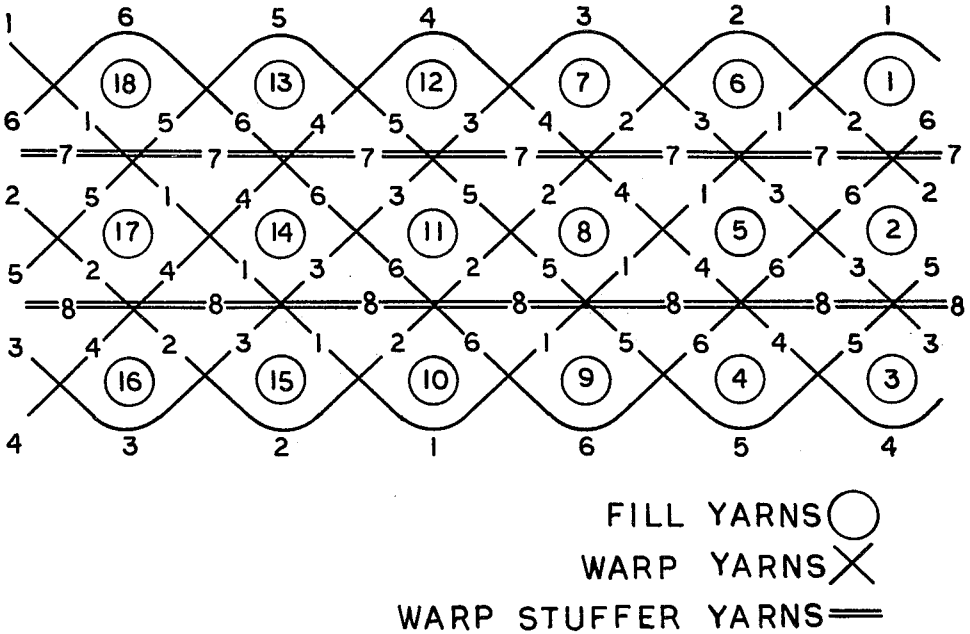

In FIG. 3, heat conduction will occur in the direction of the fabric length. The stuffer yarns are employed to increase fabric thickness. If desired, heat conduction in the perpendicular direction of the fabric can be reduced considerably if the warp stuffer yarns 7 and 8 do not have a metallized, heat conducting coating, and function as insulators. The extent of insulation provided by such uncoated warp stuffer yarns would depend on their physical size and their weave density.

In short, depending on the type of yarn, i.e., whether it is a heat conductor or insulator, and depending on the weave pattern, varying directions of heat conduction can be obtained to accommodate various end use requirements.

EXAMPLE 1

A multilayer fabric (Style 511) having a thickness of 0.088 mil, width of 4 inches, and weight 1296 grams/$M^2$ was produced by interweaving warp yarns of "RoHMOglas", metallized, coated glass fibers (360 2/6) with similar fill yarns using an angle weave on a C-3

Crompton & Knowles weaver. Significantly improved heat conductivity was obtained along the fabric length compared to the heat conductance from layered fabrics which are simply joined together by bonding with resin.

EXAMPLE 2

A multilayer fabric (Style 512) of "RoHMOglas" warp layers (360 2/6) was interwoven with fill layers of 75/2/3 E glass (non-coated fiber glass) in a C-3 Crompton & Knowles weaver using an angle weave. The fabric weight was 1507 grams/$M^2$, with a thickness of 0.089 mils, and a width of 4 inches. The fabric had good heat conducting properties along the fabric length, and good insulating properties along the transverse direction. This represented a significant improvement over multilayered fabrics that were bonded together with a resin as opposed to being interwoven according to the fabric of this invention.

EXAMPLE 3

A multilayer fabric (Style 513) having 360 2/6 warp layers interwoven with a 30 E fill (both "RoHMOglas") was produced on a weaver using an angle weave. The fabric has a weight of 1011 grams/$M^2$, a thickness of 0.053 mils, and a width of 4 inches. The fabric had significantly improved heat conducting properties compared to bonded fabric layers that were not interwoven.

It will be appreciated that many variations of this invention are possible without departing from the spirit thereof. For example, a vertical interweave may be employed rather than an angle weave, although the latter produces a stronger fabric. In addition, rather than employing only a metallic yarn or a metallized coated yarn in the warp angle interweave, to the exclusion of the other, these two yarns may be employed together as a mixture in the warp interweave.

We claim:

1. A multilayer fabric having improved heat conducting properties as follows:
   a. a plurality of fill yarn layers;
   b. an angle weave warp yarn interlocking the fill yarn layers to form a fabric structure, the angle weave traversing through the fabric structure thereby forming an outer conductive weave layer on each side of the fabric, the angle weave being selected from the class consisting of metallic fibers and fibers being totally coated with a heat conductive material thereon;
   c. the metallized fibers of the angle weave warp yarn imparting improved heating conducting properties to the fabric by absorption of heat along one side of the fabric, transmission of the heat through the fabric along the interlocking warp yarn, and radiation from the opposite side of the fabric.

2. The fabric of claim 1 in which at least one fill yarn layer contains a multiplicity of fibers, each fiber being coated with a heat conductive, metallic material.

3. The fabric of claim 1, in which the fabric has a diameter of about 18 microns and the metal comprises about 37% of the coated fiber.

4. The fabric of claim 3 in which the fabric has a thickness of 0.053 mils to 0.089 mils.

5. The fabric of claim 1, in which the yarn layers are a fill weave and the interlock comprises warp yarns.

6. The fabric of claim 1, including fill stuffer yarns.

7. The fabric of claim 1, including warp stuffer yarns.

8. The fabric of claim 1, in which the fibers are selected from the class consisting of glass, graphite, ceramic, polyester, nylon, rayon, cotton, wool, acrylonitrile, and metallic.

9. The fabric of claim 1, including an impregnation or coating resin.

10. The fabric of claim 1, including at least one uncoated yarn in the fabric to impart heat insulating effects thereto.

11. The fabric of claim 1, in which the fibers are glass with a heat conductive, aluminum coating thereon.

12. A method for producing a multilayer fabric having improved heat conduction properties, comprising:
   weaving together a plurality of yarn layers with an angle weave interlocking yarn to form a fabric structure, the angle weave traversing through the fabric structure thereby forming an outer layer on each side of the fabric;
   both the interweaving yarn and at least one yarn layer containing a multiplicity of fibers, each fiber being coated with a metallized, heat conductive material, the metallized fibers of the angle weave and the metallized yarn layer imparting improved heat conductive properties to the fabric by absorption of heat along one side of the fabric, transmission of the heat through the fabric along the interlocking warp yarn, and radiation from the opposite side of the fabric.

13. The method of claim 12, in which at least one yarn is uncoated, thereby imparting heat insulating effects to the fabric.

14. The method of claim 12, in which the fibers are selected from the class consisting of glass, graphite, ceramic, polyester, nylon, rayon, cotton, wool, acrylonitrile and metallic.

15. The method of claim 12, in which the fibers are glass with a heat conductive, aluminum coating thereon.

* * * * *